US007992719B2

(12) United States Patent
Carr et al.

(10) Patent No.: US 7,992,719 B2
(45) Date of Patent: Aug. 9, 2011

(54) COMPOSITE HOOKSTRIP SCREEN

(75) Inventors: Brian S. Carr, Burlington, KY (US); Graham Robertson, Edinburgh (GB); Eric Cady, Florence, KY (US)

(73) Assignees: M-I L.L.C., Houston, TX (US); United Wire Limited, Aberdeen Aberdeenshire (GB)

( * ) Notice: Subject to any disclaimer, the term of this patent is extended or adjusted under 35 U.S.C. 154(b) by 306 days.

(21) Appl. No.: 11/859,328

(22) Filed: Sep. 21, 2007

(65) Prior Publication Data

US 2008/0078704 A1 Apr. 3, 2008

Related U.S. Application Data

(60) Provisional application No. 60/827,467, filed on Sep. 29, 2006.

(51) Int. Cl.
*B07B 1/49* (2006.01)

(52) U.S. Cl. ..... 209/405; 209/399; 209/403; 209/409; 209/412

(58) Field of Classification Search ..... 209/395, 209/399, 403, 405, 409, 412
See application file for complete search history.

(56) References Cited

U.S. PATENT DOCUMENTS

| | | | | |
|---|---|---|---|---|
| 3,035,700 | A * | 5/1962 | McCausland | 209/405 |
| 5,927,511 | A * | 7/1999 | Riddle et al. | 209/405 |
| 6,032,806 | A * | 3/2000 | Leone et al. | 209/402 |
| 6,340,089 | B1 * | 1/2002 | Bakula | 210/388 |
| 6,672,460 | B2 * | 1/2004 | Baltzer et al. | 209/403 |
| 6,800,163 | B2 * | 10/2004 | Cook et al. | 156/160 |
| 2002/0000399 | A1 | 1/2002 | Winkler et al. | |
| 2002/0139724 | A1 | 10/2002 | Schulte et al. | |
| 2004/0251175 | A1 | 12/2004 | Adams et al. | |
| 2005/0000865 | A1 | 1/2005 | Schulte et al. | |
| 2005/0224398 | A1 * | 10/2005 | Largent et al. | 209/403 |
| 2005/0274655 | A1 | 12/2005 | Barrett et al. | |
| 2006/0163122 | A1 * | 7/2006 | Bakula | 209/405 |
| 2006/0260987 | A1 * | 11/2006 | DeCenso et al. | 209/235 |
| 2007/0007181 | A1 | 1/2007 | Barrett | |

OTHER PUBLICATIONS

PCT International Search Report issued in PCT Application No. PCT/US2007/079390 dated Feb. 15, 2008 (3 pages).
PCT Written Opinion issued in PCT Application No. PCT/US2007/079390 dated Feb. 15, 2008 (3 pages).
Examiner's Report issued in related Canadian Patent Application No. 2,664,328; Dated Jul. 7, 2010 (2 pages).
Supplementary European Search Report issued in corresponding European Patent Application No. 07 843 125.1; Dated Mar. 11, 2011 (5 pages).

* cited by examiner

*Primary Examiner* — Terrell H Matthews
(74) *Attorney, Agent, or Firm* — Osha Liang LLP

(57) ABSTRACT

A hookstrip screen assembly for use in a shaker is disclosed. The hookstrip screen assembly includes a filtering element and a composite frame further including a top surface, a bottom surface, and a plurality of filtering element attachment points. Also, the filtering element is attached to the plurality of filtering element attachment points. In another aspect, a method of forming a hookstrip screen assembly for use in a shaker. The method of forming a hookstrip screen assembly includes forming a wire structure, molding a composite frame incorporating the wire structure and forming a plurality of filtering element attachment points on the composite frame. The method also includes attaching a filtering element to the plurality of filtering element attachment points on the composite frame.

21 Claims, 4 Drawing Sheets

COMPOSITE HOOKSTRIP SCREEN

CROSS REFERENCE TO RELATED APPLICATIONS

The present application claims priority to U.S. Provisional Patent Application Ser. No. 60/827,467, filed on Sep. 29, 2006, and is hereby incorporated by reference in its entirety.

BACKGROUND

1. Field of the Disclosure

The present disclosure generally relates to shaker screens and methods of forming shaker screens. More specifically, the present disclosure relates to composite frame shaker screens and methods of forming composite frame shaker screens and attaching filtering elements thereto. More specifically still, the present disclosure relates to composite hookstrip shaker screens and methods of forming the same.

2. Background

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

One type of apparatus used to remove cuttings and other solid particulates from drilling fluid is commonly referred to in the industry as a "shale shaker." A shale shaker, also known as a vibratory separator, is a vibrating sieve-like table upon which returning solids laden drilling fluid is deposited and through which substantially cleaner drilling fluid emerges. Typically, the shale shaker is an angled table with a generally perforated filter screen bottom. Returning drilling fluid is deposited at the feed end of the shale shaker. As the drilling fluid travels down the length of the vibrating table, the fluid falls through the perforations to a reservoir below thereby leaving the solid particulate material behind. The vibrating action of the shale shaker table conveys the solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it may either return to service in the borehole immediately, be stored for measurement and evaluation, or pass through an additional piece of equipment (e.g., a drying shaker, a centrifuge, or a smaller sized shale shaker) to remove smaller cuttings and/or particulate matter.

Because shale shakers are typically in continuous use, repair operations, and associated downtimes, are need be minimized as much as possible. Often, the filter screens of shale shakers, through which the solids are separated from the drilling fluid, wear out over time and subsequently require replacement. Therefore, shale shaker filter screens are typically constructed to be quickly removable and easily replaceable. Generally, through the loosening of several bolts, the filter screen may be lifted out of the shaker assembly and replaced within a matter of minutes. While there are numerous styles and sizes of filter screens, they generally follow similar design.

Typically, filter screens include a perforated plate base upon which a wire mesh, or other perforated filter overlay, is positioned. The perforated plate base generally provides structural support and allows the passage of fluids therethrough, While many perforated plate bases are flat or slightly arched, it should be understood that perforated plate bases having a plurality of corrugated or pyramid-shaped channels extending thereacross may be used instead. Pyramid-shaped channels may provide additional surface area for the fluid-solid separation process while guiding solids along their length toward the end of the shale shaker from where they are disposed.

In typical shakers, a screen or screen assembly is detachably secured to the vibrating shaker machine. With the screen assembly or multiple screen assemblies secured in place, a tray is formed with the opposed, parallel sidewalls of the shaker. The drilling mud, along with drill cuttings and debris, is deposited on the top of the screen assembly at one side. The screen assembly is vibrated at a high frequency or oscillation by a motor or motors for the purpose of screening or separating materials placed on the screen. The liquid and fine particles will pass through the screen assembly by force of gravity and be recovered underneath. The solid particles above a certain size migrate and vibrate across the screen or screens where they are removed.

It is known that to obtain the proper vibration of the screen assembly, slack in the screens must be discouraged. Any slack in the screen produces an undesirable flapping action of the screen, which reduces the effectiveness of the shaker vibration and also results in increased wear of the screen. Accordingly, it is known that the screen should be securely and tightly held down to the vibrating machinery by an attachment mechanism.

One type of attachment mechanism includes hooks on each longitudinal end of the screen assembly to connect to the shaker. The shaker will have a channel-shaped drawbar on each side, which mates with a corresponding hook on the screen assembly. The drawbars are held in place by bolts or other fasteners. These are detachably connected so that the screens may be replaced from time to time. Such screens are referred to in the industry as "hookstrip screens."

Typically, hookstrip screens are manufactured by first forming a metal perforated plate (i.e., a backplate) which serves as support structure for the screen assembly. The metal perforated plate is often heavy, expensive to manufacture, and blocks a substantial portion of potential screen area. During screen manufacture a screen surface (i.e., a filtering element) is attached to the metal perforated plate with powder epoxy. When the powder epoxy is melted, and the screen surface attached to the metal perforated plate, the epoxy spreads over the screen surface thereby blocking screening surface. The bonding process is also relatively long, in some instances lasting anywhere from 5 to 15 minutes.

Accordingly, there exists a need for a relatively inexpensive hookstrip screen that may provide an effective surface for the screening of drilling fluids. Also, there exists a need to increase the efficiency of the screening process so that downtime may be limited while increasing the rate of screening.

SUMMARY OF THE DISCLOSURE

According to one aspect, embodiments disclosed herein relate to a hookstrip screen assembly for use in a shaker. The hookstrip screen assembly includes a filtering element and a composite frame further including a top surface, a bottom surface, and a plurality of filtering element attachment points. Also, the filtering element is attached to the plurality of filtering element attachment points.

In another aspect, embodiments disclosed herein relate to a method of forming a hookstrip screen assembly for use in a shaker. The method of forming a hookstrip screen assembly includes forming a wire structure, molding a composite frame incorporating the wire structure and forming a plurality of filtering element attachment points on the composite frame. The method also includes attaching a filtering element to the plurality of filtering element attachment points on the composite frame.

Other aspects of the present disclosure will be apparent from the following description and appended claims.

DETAILED DESCRIPTION

Generally, embodiments disclosed herein relate to shaker screen assemblies including composite frame and filtering elements. Additionally, methods disclosed herein relate to methods of forming shaker screen assemblies including composite frame and filtering elements.

Figure 1:
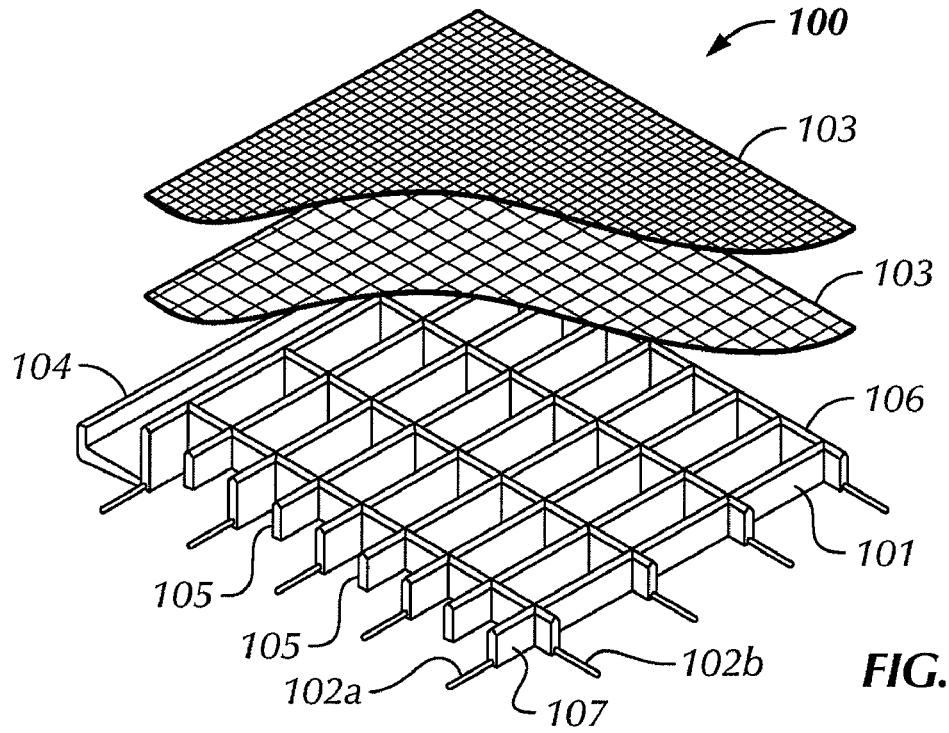
FIG. 1 is a break away view of a hookstrip screen assembly in accordance with one embodiment of the present disclosure.

Referring initially to FIG. 1, a break away view of a hookstrip screen assembly 100 in accordance with one embodiment of the present disclosure is shown. In this embodiment, screen assembly 100 includes a composite frame 101, a wire structure 102, and a plurality of filtering elements 103. Screen assembly 100 also includes a hookstrip attachment extension 104 that provides a way to attach screen assembly 100 to a shaker body (not shown). Typically, hookstrip attachment extension 104 is placed within a tensioning mechanism (not shown) on the shaker body, and as tension is applied to hookstrip attachment extension 104, screen assembly 100 may be securely fastened to the shaker body. Such hookstrip attachment extensions 104 are well known to those of ordinary skill in the art as providing a method of securing shaker screen assemblies to shaker bodies.

Composite frame 101 may be formed from any material known to one of ordinary skill in the art including, but not limited to, high-strength plastic, mixtures of high-strength plastic and glass, high-strength plastic reinforced with high-tensile-strength steel rods, and any combinations thereof. By using composite frames 101, embodiments of the present disclosure may provide a lighter weight frame with increased durability and strength over conventional steel frames. Additionally, composite frames 101 may be formed with integral wire structure 102.

Composite frames in accordance with embodiments of the present disclosure may be formed by a number a methods known to those of ordinary skill in the art of plastics manufacture. One such method of forming composite frames may include injection molding and/or gas injection molding. In such an embodiment, a composite or polymer material may be formed around a wire structure and placed in a mold. The mold may be closed around the wire structure and a liquid polymer injected therein. Upon curing, a force may be applied to opposing sides of the mold thereby allowing the formed frame to separate from the mold. In alternate methods of injection molding, gas may be injected into a mold to create spaces in the composites that may later be filled with alternate materials.

As illustrated by FIG. 1, composite frame 101 may be formed with a single longitudinal wire structure 102*a* and a single latitudinal wire structure 102*b*. In such an embodiment, prior to injection molding, longitudinal and latitudinal wire structures 102*a* and 102*b* may be welded together thereby creating a wire grid. The wire grid may then be encapsulated in any number of polymeric materials, such as, for example, thermoplastics and/or polypropylene foam. Such polymeric materials provide a light weight composite that has high strength characteristics and substantial resistance to chemical and corrosive substances that may be present in drilling fluids. One of ordinary skill in the art will appreciate that other materials may be used without departing from the scope of the present disclosure.

Still referring to FIG. 1, composite frame 101 may also be formed to include filtering element attachment points 105 located on a top surface 106 of composite frame 101. As illustrated, filtering element attachment points 105 include raised ridges on composite frame 101 that allow a location of attachment for filtering elements 103. In this embodiment, two filtering elements 103 are illustrated relative to their attachment points on top surface 106.

Filtering elements 103 may include, for example, a mesh, a fine screen cloth, or other materials known to one of ordinary skill in the art. Additionally, filtering element 103 may be formed from plastics, metals, alloys, fiberglass, composites, and/or polytetrafluorethylene. In certain embodiments, a plurality of layers of filtering elements 103 may be incorporated into one screen assembly 100 to define a desired separation efficiency or cut. However, in alternate embodiments, filtering element 103 may include a single layer (not shown).

Figure 2:
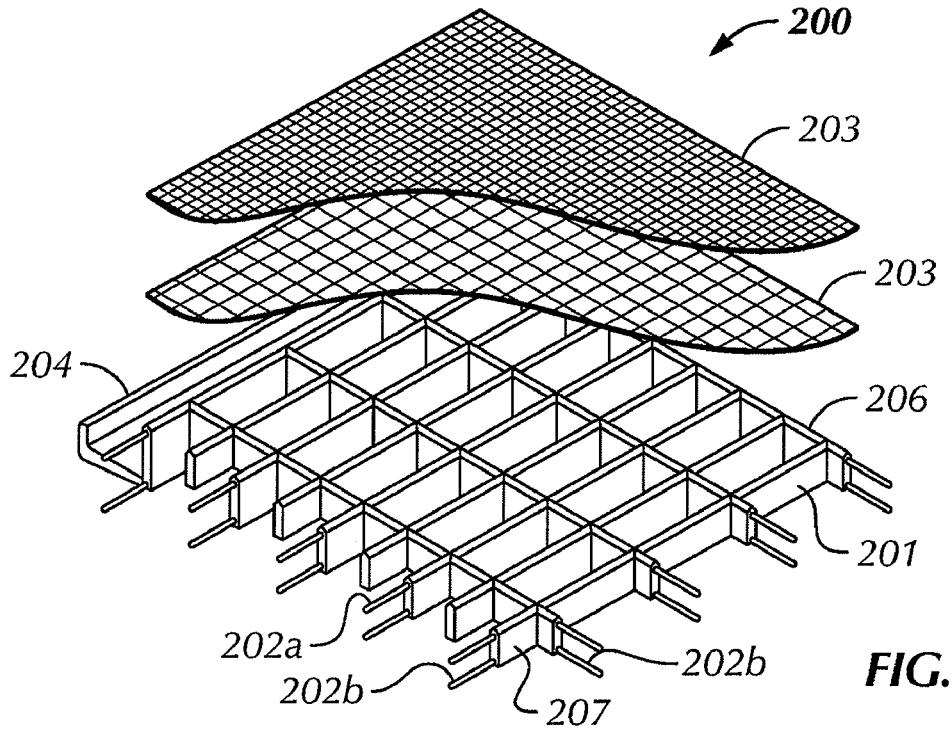
FIG. 2 is a break away view of an alternate hookstrip screen assembly in accordance with one embodiment of the present disclosure.

Referring now to FIG. 2, a break away view of an alternate hookstrip screen assembly 200 in accordance with one embodiment of the present disclosure is shown. This embodiment includes all of the structural features as illustrated in FIG. 1, however, screen assembly 200 includes multiple levels of wire structure 202*a* and 202*b* encapsulated within composite frame 201. As illustrated, a first wire structure 202*a* may be encapsulated proximate to a top surface 206 of composite frame 201. Additionally, a second wire structure 202*b* may be encapsulated proximate to a bottom surface (not shown) of composite frame 201. Both first and second wire structures 202*a* and 202*b* may run laterally and longitudinally along composite frame 201. While using a plurality of wire structures may increase the weight of screen assembly 200 relative to screen assembly 100 of FIG. 1, one of ordinary skill in the art will appreciate that in certain applications a more rigid frame may be preferable.

Figure 3:
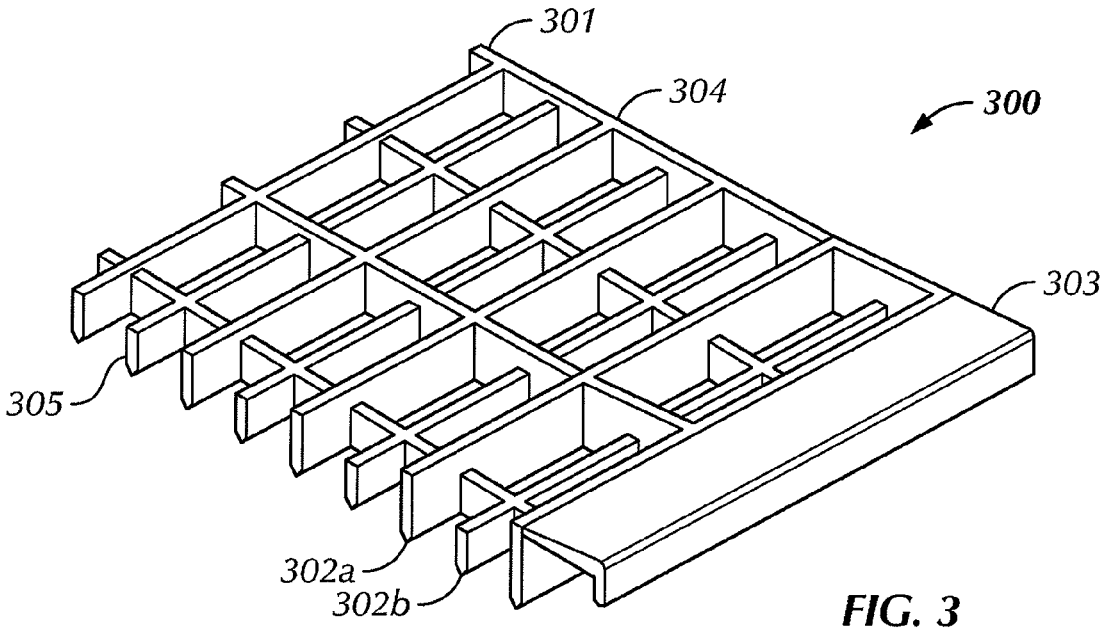
FIG. 3 is a cross-section view of a hookstrip screen in accordance with one embodiment of the present disclosure.

Referring now to FIG. 3, a cross-section view of a hookstrip screen 300 in accordance with one embodiment of the present disclosure is shown. In this embodiment, composite frame 301 is formed incorporating a plurality of ribs 302. As illustrated, composite frame 301 may have ribs 302 of different lengths. For example, in one embodiment, it may be beneficial to include long ribs 302*a*, while in other embodiments it may be beneficial to include short ribs 302*b*. The alternating ribs 302 may provide a close grid for supporting filtering elements (not shown). One of ordinary skill in the art will appreciate that in certain embodiments it may be preferable to form composite frames 301 with only long ribs 302*a*, only short ribs 302, mixtures of ribs 302, or no ribs at all. Additionally, FIG. 3 illustrates an alternate hookstrip attachment mechanism. In this embodiment, hookstrip 303 is formed proximate a top surface 304, instead of being formed as an extension of a bottom surface 305, as is illustrated in FIG. 1 and FIG. 2.

Figure 4:
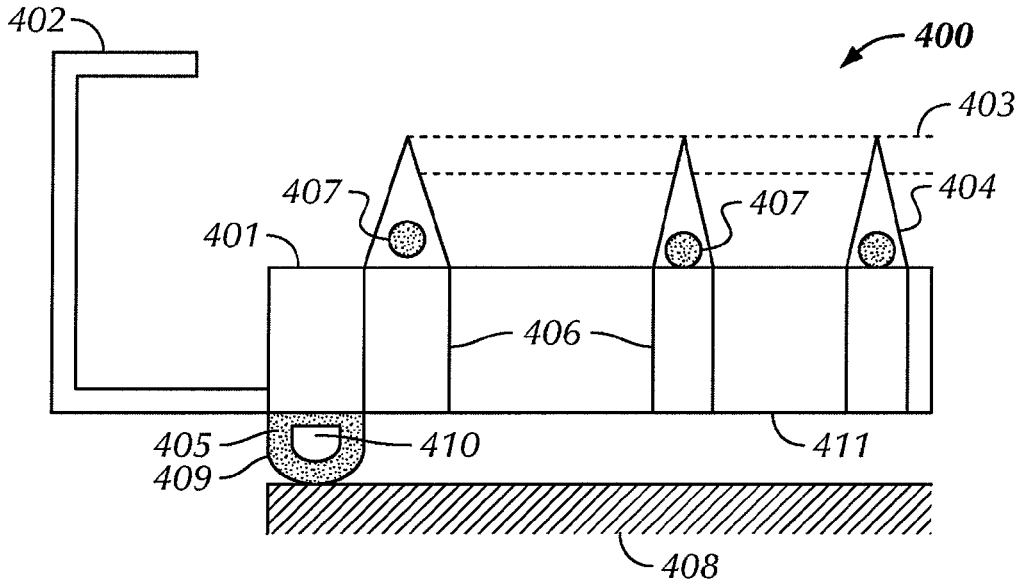
FIG. 4 is a cross-section view of a hookstrip screen in accordance with one embodiment of the present disclosure.

Referring now to FIG. 4, a cross-section view of a hookstrip screen 400 in accordance with one embodiment of the present disclosure is shown. In this embodiment, a composite frame 401 is illustrated including a hookstrip attachment extension 402, a plurality of filtering elements 403, a plurality of filtering element attachment points 404, and a sealing element 405. As shown, composite frame 401 may be formed with a plurality of ribs 406, filtering element attachment points 404 extending therefrom. Additionally, filtering element attachment points 404 have been molded to incorporate a wire structure 407.

In this embodiment, filtering element attachment points 404 are molded out of the same material as the rest of composite frame 401. As such, the plurality of filtering elements 403 may be attached directly thereto. For example, filtering element attachment points 404 may be heated such that they begin to melt. Before the composite cures, one or more filtering elements 403 may be bonded directly to the softened composite. Previously, a filtering elements would be attached to a frame using powder epoxy or other chemical methods of attachment. However, the epoxies and other chemicals often react with the drilling fluid being screened, therein causing the filtering element to loosen from the frame. Filtering element attachment points 404 of the present disclosure may be formed from composites, and thus, may be melted directly into composite frame 401. Because the composites of the frame and filtering element attachment points do not generally react with the drilling fluid being processed, the chance of filtering elements 403 loosening as a result of interaction with drilling fluid is decreased. In alternate embodiments, plurality of attachment points 404 may be formed integral to composite frame 401 so as to create a substantially planar surface (e.g., along the entire surface of composite frame 401). In such an embodiment, filtering element 403 may be attached to attachment points 404 by, for example, pressing filtering element 403 directly onto heated sections of composite frame 401 including such planar attachment points 404. One of ordinary skill in the art will appreciate that the level of protrusion of attachment points 404, from composite frame 401, may be varied according to a given operation to provide effective bonding between filtering element 401 and composite frame 401.

Also in this embodiment sealing element 405 is illustrated disposed between composite frame 401 and a sealing surface 408. Sealing element 405 may be formed from any sealing substance know to one of ordinary skill in the art including, but not limited to, rubbers, thermoplastic elastomers ("TPE"), foams, polychloroprene, polypropylene, and/or any combinations thereof. Sealing elements 405 formed from TPE may include, for example, polyurethanes, copolyesters, styrene copolymers, olefins, elastomeric alloys, polyamides, or combinations of the above. Preferably, the sealing element should include properties that allow high durability and elongation, as well as solvent and abrasion resistance. In certain embodiments, sealing element 405 may preferably include the properties of increased flexibility, slip resistance, shock absorption, and vibration resistance. However, one of ordinary skill in the art will appreciate that in alternate embodiments, sealing elements including greater solvency resistance, durability, abrasion resistance, or any other factor corresponding to increased seal life may determine which sealing element is selected.

Sealing element 405 may be formed so as to include an outer surface 409 and an inner area 410. In one embodiment outer surface 409 may be formed from a lower durometer material than the material of inner area 410. By forming outer surface 409 from a lower durometer material, the lower durometer material may compress more easily against a sealing surface 408. Because outer surface 409 may have a greater resistance to permanent indentation, outer surface 410 may more fully compress against sealing surface 408. Generally, sealing surface 408 may be the frame of a shaker basket (not independently shown) or another component of a given shaker.

Additionally, inner area 410 may be formed from a relatively higher durometer material. In one embodiment, inner area 410 may be formed from a higher durometer material of similar composition, such as a corresponding TPE. In such an embodiment, the lower durometer material may compress against sealing surface 408 until outer surface 409 has compressed fully against inner area 410. Inner area 410, because of its high durometer properties, may provide resistance to compression such that a seal is formed between sealing element 405 and sealing surface 408.

In alternate embodiments, inner area 410 may be filled with a secondary sealing material. One such secondary sealing material may include a foam. The foam may provide resistance to compression, as described above, so as to increase the seal integrity between sealing element 405 and sealing surface 408. Another secondary sealing material may include a gas. Similar to the compressive properties of a foam, a gas may limit the compression of sealing element 405 to a specified range so as to increase the seal integrity between sealing element 405 and sealing surface 408. One of ordinary skill in the art will realize that an inner area 410 may be filled with any substance known to increase the sealing integrity of sealing element 405, or in certain embodiments, if preferable, be left unfilled.

As illustrated, sealing element 405 is embedded within the profile of composite frame 401. In such an embodiment, sealing element 405 and composite frame 401 may be formed contemporaneously. One such method of forming and attaching sealing element 405 and composite frame 401 may include co-molding, using, for example, injection molding and/or gas injection molding, as is known to those of ordinary skill in the art of molding plastics.

One method of co-molding sealing element 405 and composite frame 401 may include integrally molding sealing element 405 within composite frame 401. In this embodiment, sealing element 405 may be positioned within an injection mold for composite frame 401. Once the mold is sealed, a sealing element material (e.g., TPE) may be injected into the mold. The sealing element material is allowed to cure, and then the screen frame including an integrally molded sealing element may be removed. One of ordinary skill in the art will appreciate that alternative methods of attaching a sealing element to a composite frame exist, for example, using an adhesive resin, and as such, are within the scope of the present disclosure.

Still referring to FIG. 4, in this embodiment of the present disclosure, a D-shaped sealing element 405 is attached to composite frame 401. Sealing element 405 may be attached to composite frame 401 according to any of the methods described above. Additionally, sealing element 405 is shown attached along a basal perimeter 411 of composite frame 401. Basal perimeter 411 defines a bottom surface of a composite frame, which absent a sealing element, would contact a sealing surface of a shaker.

D-shaped sealing element 405 includes an outer surface 409 and an inner area 410. In such an embodiment, inner area 410 may be filled with a foam or gas, as described above, or may be left unfilled. As illustrated, D-shaped sealing element 405 may extend along substantially the entire width of composite frame 401. Thus, the compression resistance of this embodiment relies on the elastomeric properties of sealing element 405, rather than the rigid section of the previous embodiments. However, in such an embodiment, one of ordinary skill in the art will appreciate that a rigid section (not independently illustrated) integral to composite frame 401 may still provide structural support for the shaker screen and/or optimization of seal compression. Alternate embodiments of sealing elements that may be used in the present disclosure are disclosed in co-pending U.S. Patent Application Ser. No. 60/827,550, titled Sealing System for Pre-Tensioned Composite Screens, invented by Brian Carr, et al. filed concurrently herewith, assigned to the assignee of the present application, and herein incorporated by reference in its entirety.

Figure 5:
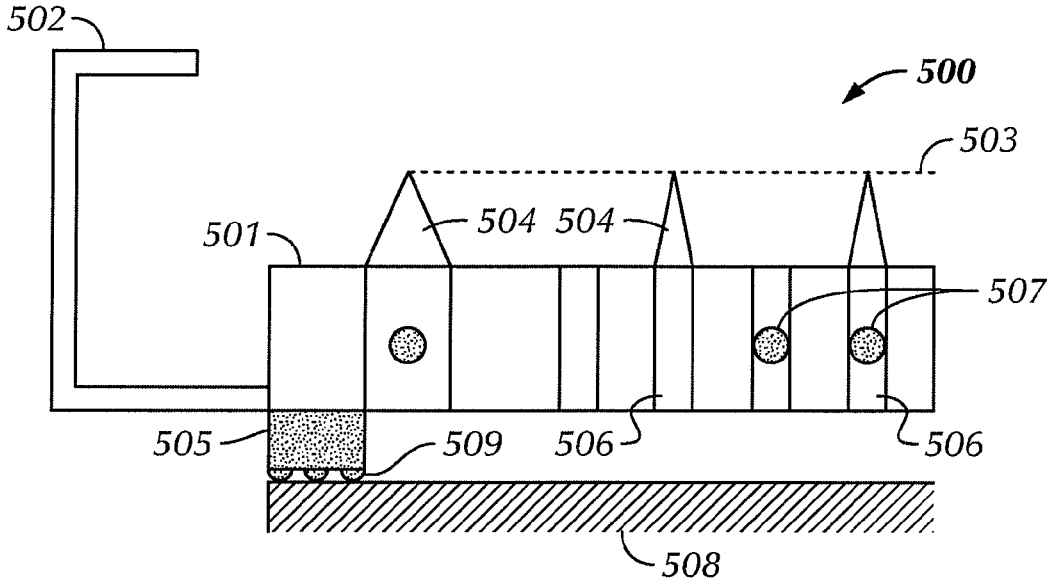
FIG. 5 is a cross-section view of an alternate hookstrip screen in accordance with one embodiment of the present disclosure.

Referring now to FIG. 5, a cross-section view of a hookstrip screen 500 in accordance with one embodiment of the present disclosure is shown. In this embodiment, a composite frame 501 is illustrated including a hookstrip attachment extension 502, a single filtering element 503, a plurality of filtering element attachment points 504, and a sealing element 505. As shown, composite frame 501 may be formed with a plurality of ribs 506 and filtering element attachment points 504 extending therefrom. In this embodiment, wire structure 507 is molded into composite frame 501.

In this embodiment, a ribbed sealing element 505 is attached to composite frame 501 according to the methods of attachment described above. Seal ribs 509 may provide additional sealing integrity for shaker screen 500. As a compressive force is applied to shaker screen 500, sealing element 502 may be compressed against sealing surface 508. Seal ribs 509 may provide resistance to the compressive force, thereby providing greater seal integrity between composite frame 501 and sealing surface 508. Additionally, because there may exist a plurality of seal ribs 509, should one such seal rib 509 suffer unequal wear and/or damage during its life, the other seal ribs may continue to provide an ample seal so as to extend the total life of shaker screen 500.

Those of ordinary skill in the art will appreciate that in certain embodiments, wire structure 507 may not be necessary in every rib 506. Additionally, in certain embodiments ribs 506 may be bonded directly to filtering element 503 without the specific use of filtering element attachment point 504. As such, depending on the specific screen 500, ribs 506 may be of different lengths, and include varied composition to account for the design requirements of a specific shaker operation.

Figure 6:
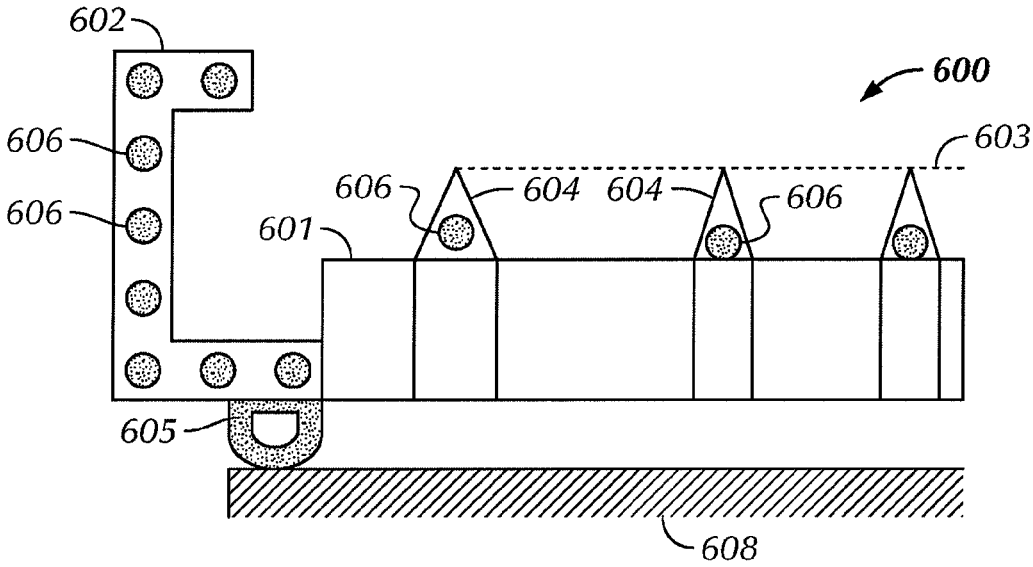
FIG. 6 is a cross-section view of an alternate hookstrip screen in accordance with one embodiment of the present disclosure.

Referring now to FIG. 6, a cross-section view of a hookstrip screen 600 in accordance with one embodiment of the present disclosure is shown. In this embodiment a composite frame 601 is illustrated including a hookstrip attachment extension 602, a single filtering element 603, a plurality of filtering element attachment points 604, and a sealing element 605.

In this embodiment, as illustrated, composite frame 601 may be formed with a wire structure 606 molded into hookstrip attachment extension 602. Additionally, wire structure 606 is molded into filtering element attachment points 604. By molding the wire structure into different locations throughout composite frame 601, one of ordinary skill in the art will appreciate that structural integrity of screen assembly 600 may be increased as needed. For example, by adding wire structure 606 in hookstrip attachment extension 602 the level of tension transferred from hookstrip attachment extensions 602 and the rest of composite frame 601 may be adjusted. In one embodiment, it may be beneficial to provide increased tensile strength in hookstrip attachment extensions 602 by, for example, increasing the diameter of wire structure 606. However, in other embodiments, it may be beneficial to exclude wire structure 606 from hookstrip attachment extension 602. One of ordinary skill in the art will appreciate that by forming composite frames in accordance with embodiments disclosed herein, properties of hookstrip attachment extensions 602 may be varied to provide a more beneficial composite integrity and/or better sealing surfaces with the shaker.

Figure 7:
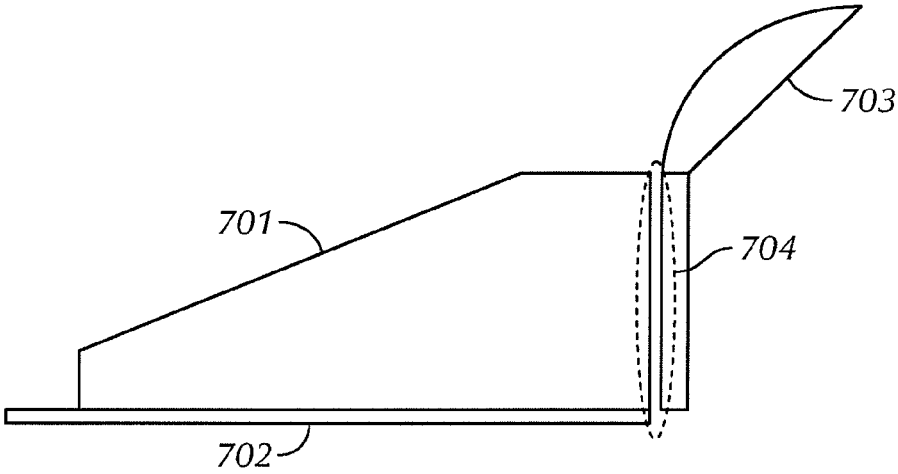
FIG. 7 is a cross-sectional view of a wiper seal in accordance with one embodiment of a hookstrip screen of the present disclosure.

Referring now to FIG. 7, a cross-sectional view of a wiper seal in accordance with one embodiment of a shaker screen of the present disclosure is shown. In some embodiments, the shaker screen and/or filtering element may include a plurality of hold-down apertures at opposite ends of the screen. These apertures, generally located at the ends of the shaker screen abut walls of the shaker, thereby allowing hold-down retainers of the shale shaker to secure the shaker screens in place. Because of the retainers proximity to the working surface of the shaker screen, the hold-down apertures must be covered to prevent solids in the drilling fluid from bypassing the shaker screen through the hold-down apertures. To prevent such bypass, an end cap assembly may be placed over each end of the filter screen to cover the hold-down apertures. Typically, such end caps are constructed by extending a metal cover over the hold-down apertures and attaching a wiper seal thereto so that the wiper seal contacts an adjacent wall of the shaker. Generally, wiper seals may be formed from any material capable of creating a seal between the shaker screen and the shaker. However typically, wiper seals are formed from rubbers, TPE, polychloroprene, polypropylene, and/or combinations thereof.

In one embodiment of the present disclosure, a thermoplastic end cap 701, formed by, for example, the injection molding process as described above, or any other method known to one of ordinary skill in the art, may be attached to a surface structure on the shaker screen 702. One such attachment point may include a metal plate located along the frame of the shaker. In alternate embodiments, end cap 702 may be directly coupled to the composite frame (not shown). In such embodiments, a wiper seal 703 may be attached to end cap 701 so as to form a seal between the shaker screen 702 and the shaker. Because the end cap 701 may be formed from a composite, wiper seal 703 may be attached using, for example, thermal bonding, ultrasonic welding, or heat staking, as described above. An attachment zone 704 provides an area of attachment for wiper seal 703 to either shaker screen 702 or to the composite frame. Because end cap 701 may be formed from a composite material, wiper seal 703 may be attached using, for example, thermal bonding, ultrasonic welding, or heat staking, as described above. In alternate embodiments, wiper seal 703 may be directly attached to the composite frame using any of the aforementioned methods of attachment. Other examples of end caps that may be used in accordance with embodiments of the present disclosure are described in U.S. patent application Ser. No. 11/174,875, titled Molded End Cap for Oilfield Screens, filed on Jul. 5, 2005, invented by Robert M. Barrett et al., assigned to the assignee of the present application, and herein incorporated by reference in its entirely.

Advantageously, embodiments of the aforementioned apparatuses and methods may increase the efficiency of shaker systems for the separation of drilling fluid from drill cuttings. Because the sealing elements of the present disclosure may be directly attached to composite frames using thermal bonding and/or co-molding, a higher integrity seal may be formed therebetween. Additionally, composite screens cost less to manufacture than prior art metal screens. As such, the cost of separating drilling fluids from drill cuttings and the cost of building, maintaining, and repairing shakers may be reduced. For example, whereas prior art cycle times for bonding filtering elements to frames may take from 5-15 minutes, embodiments disclosed herein may be bonded in a matter seconds. In certain embodiments, cycle times may take anywhere from 20 to 180 seconds. In other embodiments, cycle times may take slightly longer to complete, thereby extending the bonding process.

Furthermore, shaker screens in accordance with the present disclosure may decrease the cost and time of repairing seals. Because the sealing elements may be formed around a basal perimeter of the shaker screens, and not around an inner perimeter of the shaker, when seal damage occurs, only the screen must be replaced. One of ordinary skill in the art will appreciate that replacing a screen with an attached sealing element is less labor intensive and requires less time than replacing a sealing element located on the inner perimeter of a shaker. Thus, sealing elements that are thermally bonded and/or co-molded to a composite frame, as disclosed herein, may decrease the cost of routine maintenance thereby increasing the cost efficiency of the shaking process.

Also, thermal bonding and co-molding techniques described herein may provide advantageous sealing element design variations. Initially, powder epoxies currently used block potential screen surfaces when melted onto the surface of metal screens. Because sealing elements of the present disclosure may be melted into the composite frames, less potential seating area may be obstructed. Further, the sealing elements may be attached to the composite frame using such thermal bonding and co-molding there may be less of a need to use epoxies and chemical bonding techniques. Such epoxy and chemical bonding techniques created attachments that degraded over time due to contact with abrasive drilling fluids. As such, chemically bonded seals may have a shorter effective life relative to embodiments of the present disclosure. Additionally, because thermal bonding and co-molding techniques do not use environmentally hazardous chemicals, processes of the present disclosure are more environmentally sensitive.

Moreover, design variations of the sealing elements in accordance with embodiments disclosed herein may provide greater integrity seals. Sealing elements of the present disclosure may include an outer surface and an inner area that enhances sealing integrity between the shaker screen and the shaker. Specifically, because a lower durometer material may form an outer surface while higher durometer material may form an inner area, the compression of the seal may be optimized for a specified operation. Also, embodiments disclosed herein provide the advantage of allowing an inner core to be filled with compressive material (e.g., foam) or other materials (e.g., gases) such that the formation of the sealing element alone may provide optimization of seal compression. Other design variations may provide optimized sealing compression through, for example a plurality of ribs, thereby increasing seal integrity.

Finally, embodiments in accordance with the present disclosure may advantageously allow the attachment of alternative sealing elements (e.g., wiper seals) to the shaker screen frame or extensions thereof. Of particular advantage in certain embodiments, a wiper seal may be attached directly to a composite frame or directly to an end cap such that more drilling fluids are retained over the screen surface rather than escaping through attachment apertures of the shaker screen.

While the present disclosure has been described with respect to a limited number of embodiments, those skilled in the art, having benefit of this disclosure, will appreciate that other embodiments may be devised which do not depart from the scope of the present disclosure as described herein. Accordingly, the scope of the invention should be limited only by the attached claims.

What is claimed is:

1. A hookstrip screen assembly for use in a shaker, the screen assembly comprising:

a filtering element; and a composite frame comprising a top surface, a bottom surface, a plurality of raised filtering element attachment points, and a wire structure including multiple levels with a first encapsulated wire structure proximate the top surface and a second encapsulated wire structure proximate the bottom surface;

wherein the filtering element is attached to the plurality of raised filtering element attachment points.

2. The hookstrip screen assembly of claim 1, further comprising:

a sealing element attached to the composite frame.

3. The hookstrip screen assembly of claim 2, wherein the sealing element is attached to the composite frame through co-molding.

4. The hookstrip screen assembly of claim 2, wherein the sealing element is attached to the composite frame through thermal bonding.

5. The hookstrip screen assembly of claim 2, wherein the sealing element comprises at least one support rib.

6. The hookstrip screen assembly of claim 2, wherein an inner area of the sealing element is substantially hollow.

7. The hookstrip screen assembly of claim 2, wherein an inner area of the sealing element is substantially gas-filled.

8. The hookstrip screen assembly of claim 2, wherein an inner area of the sealing element is foam-filled.

9. The hookstrip screen assembly of claim 2, wherein the sealing element further comprises a thermoplastic elastomer shell.

10. The hookstrip screen assembly of claim 2, wherein an outer surface of the sealing element comprises a lower durometer material than an inner area of the sealing element.

11. The hookstrip screen assembly of claim 1, wherein the filtering element is attached to the plurality of raised filtering element attachment points through thermal bonding.

12. The hookstrip screen assembly of claim 1, further comprising an end cap.

13. The hookstrip screen assembly of claim 12, further comprising a wiper seal attached to the end cap.

14. The hookstrip screen assembly of claim 13, wherein the wiper seal is attached to the end cap through thermal bonding.

15. The hookstrip screen assembly of claim 1, wherein the plurality of raised filtering element attachment points comprise a substantially planar surface.

16. A method of forming a hookstrip screen assembly for use in a shaker, the method comprising:

forming a wire structure including multiple levels, the wire structure comprising a first wire proximate the top surface and a second wire proximate the bottom surface;

molding a composite frame incorporating the wire structure;

forming a plurality of raised filtering element attachment points on the composite frame; and attaching a filtering element to the plurality of filtering element attachment points on the composite frame.

17. The method of forming a hookstrip screen assembly of claim 16, further comprising:

attaching a sealing element to a basal perimeter of the composite frame.

18. The method of forming a hookstrip screen assembly of claim 17, further comprising:

attaching an end cap to the composite frame; and bonding a wiper seal to the end cap.

19. The method of forming a hookstrip screen assembly of claim 16, wherein the plurality of raised filtering element attachment points comprise a substantially planar surface.

20. The method of forming a hookstrip screen assembly of claim 17, wherein the attaching the sealing element to the basal perimeter of the composite frame comprises co-molding the sealing element to the basal perimeter of the composite frame.

21. The method of forming a hookstrip screen assembly of claim 16, wherein the attaching the filtering element to the filtering element attachment points on the composite frame comprises thermally bonding the filtering element to the raised filtering element attachment points on the composite frame.

* * * * *